US006797678B2

(12) United States Patent
Hata et al.

(10) Patent No.: US 6,797,678 B2
(45) **Date of Patent: *Sep. 28, 2004**

(54) LUBRICANT ADDITIVE

(75) Inventors: Hitoshi Hata, Chiba-ken (JP); Hiromichi Seiki, Chiba-ken (JP); Hisashi Machida, Kanagawa-ken (JP)

(73) Assignees: Idemitsu Kosan Co., Ltd., Tokyo (JP); NSK Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/989,076

(22) Filed: Nov. 21, 2001

(65) Prior Publication Data

US 2002/0055441 A1 May 9, 2002

Related U.S. Application Data

(62) Division of application No. 09/541,712, filed on Apr. 3, 2000, now Pat. No. 6,352,962.

(51) Int. Cl.[7] ..... C10M 159/12; C10M 137/00
(52) U.S. Cl. ..... 508/188
(58) Field of Search ..... 508/188

(56) References Cited

U.S. PATENT DOCUMENTS

| | | | |
|---|---|---|---|
| 3,502,677 A | | 3/1970 | Le Suer |
| 4,338,205 A | | 7/1982 | Wisotsky |
| 4,855,074 A | | 8/1989 | Papay et al. |
| 5,256,324 A | | 10/1993 | Papay |
| 5,439,606 A | | 8/1995 | Papay |
| 6,303,546 B1 | | 10/2001 | Hata et al. |
| 6,352,962 B1 | * | 3/2002 | Hata et al. |

FOREIGN PATENT DOCUMENTS

| | | |
|---|---|---|
| EP | 0 531 000 A1 | 3/1993 |
| EP | 0 537 387 A1 | 4/1993 |

* cited by examiner

*Primary Examiner*—Jerry D. Johnson
(74) *Attorney, Agent, or Firm*—Oblon, Spivak, McClelland, Maier & Neustadt, P.C.

(57) ABSTRACT

A lubricant additive obtained by heating an acidic phosphate ester and/or a phosphite ester (A) represented by the general formula (I):

(I)

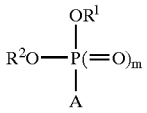

(wherein A represents H or OH, m is 0 or 1, when m is 0, A is OH, and when m is 1, A is H or OH, $R^1$ and $R^2$ each independently represent H, or a hydrocarbon group having 1 to 18 carbon atoms that may contain at least one O and S, both $R^1$ and $R^2$ are not simultaneously hydrogen atoms) and an imide-based dispersant containing boron (B) at a temperature of 120 to 150° C. for 5 hours or more, which can concurrently enhance excellent wear resistance, excellent scoring resistance and prolong surface fatigue life while keeping the balance of these properties at an optimum level.

7 Claims, No Drawings

LUBRICANT ADDITIVE

BACKGROUND OF THE INVENTION

1. Field of the Invention

The present invention relates to a novel lubricant additive and a lubricant, and particularly to a traction drive fluid. More particularly, the present invention relates to a lubricant used for automobile transmissions in a traction drive type, a push-belt type, a gear (manual) type, a automatic transmission and the like, particularly to an additive and a lubricant that concurrently provide excellent scoring resistance, excellent wear resistance, prolonged surface fatigue life or the like with the traction drive liquid for use in automobile continuous variable transmissions, while keeping the balance of these properties at an optimum level.

2. Description of the Related Art

Automobile transmissions such as a gear (manual) type transmission, a automatic transmission, a push-belt type continuous variable transmission and a traction drive continuous variable transmission are known. These mechanically comprise contact portions having high surface pressure such as a traction drive rolling surface, a gear and a ball-and-roller bearing. Accordingly, lubricants having excellent wear resistance and scoring resistance have been used to prevent the contact portions from wearing and scoring (seizing) and to attain a high traction factor as needed. In the lubricant for the automobile transmissions, especially the traction drive fluid used for the automobile continuous variable transmissions, a mixture of a sulfur-based additive and a phosphorus-based additive that has excellent wear resistance and scoring resistance has been conventionally used.

In recent years, the automobile transmissions are designed to be miniaturized, light-weighted, and to have maximized transmission capacity. A main damage on the lubricated portions of the automobile transmissions is caused by surface fatigue such as pitting.

The mixture of the sulfur-based additive and the phosphorus-based additive that has excellent wear resistance and scoring resistance has less effective to the surface fatigue, rather adversely affects thereon. Therefore, there is a need for an additive that provides excellent wear resistance, excellent scoring resistance and prolonged surface fatigue life with the lubricant for the automobile transmissions, especially the traction drive liquid for use in automobile continuous variable transmissions.

Examples of phosphate ester-based and phosphite ester-based lubricant additives include (1) a compound having the following general formula (II):

(II)

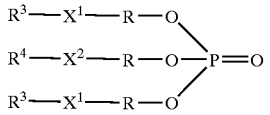

wherein R represents an alkyl group having 2 or 3 carbon atoms, $R^3$, $R^4$ and $R^5$ each independently represent an alkyl group having 1 to 18 carbon atoms, and $X^1$, $X^2$ and $X^3$ each independently represent O or S as disclosed in the U.S. Pat. No. 2,750,342, (2) an ester comprising an aromatic amine and a compound having the following general formula (III):

(III)

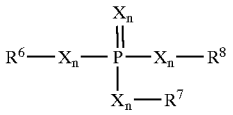

wherein X represents O or S, at least one X is S; n is 0 or 1, at least three ns are 1; $R^6$ to $R^8$ independently represent an alkyl group or an aromatic group as disclosed in the U.S. Pat. No. 3,446,738, (3) a compound having the following general formula (IV)

Ya—S—Yb (IV)

wherein Ya is a group represented by

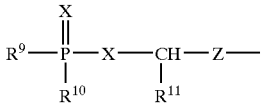

Z represents a divalent hydrocarbyl group, $R^9$ and $R^{10}$ independently represent a hydrocarbyl group, a hydrocarbyloxy group or a hydrocarbyl mercapto group having 1 to 10 carbon atoms, $R^{11}$ represents a hydrogen atom or a hydrocarbyl group, X presents O or S, Yb represents —$R^{12}$H or —$R^{12}$—S—$R^{13}$ (wherein $R^{12}$ represents a divalent hydrocarbyl group having 1 to 30 carbon atoms and $R^{13}$ represents a hydrogen atom or Ya) as disclosed in the U.S. Pat. No. 4,081,387, (4) a compound having the following general formula (V):

(V)

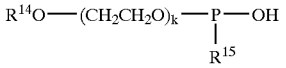

wherein $R^{14}$ represents an alkyl group or an alkenyl group, $R^{15}$ represents a hydroxyl group, an alkoxyl group, an alkenyloxy group or $R^{14}O—(CH_2CH_2O)_k—$, wherein k is an integer of 2 to 4 as disclosed in the U.S. Pat. No. 4,579,672, (5) a compound having the following general formula (VI):

(VI)

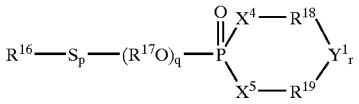

wherein $R^{16}$ represents a hydrocarbon group, p is 1 to 3, $R^{17}$ represents an alkylene group, q is 1 to 12, $X^4$ and $X^5$ independently represent —O—, —NH— or —S—, $R^{18}$ and $R^{19}$ independently represent an alkylene group, r is 0 or 1 with the proviso that when r is 1, $Y^1$ is —O—, —NH—, —S—, —S—S— or —$CH_2$—; when r is O, $R^{18}$ and $R^{19}$ are combined to form a heterocyclic structure as disclosed in the U.S. Pat. No. 4,776,969, (6) a reaction product of a sulfur composition, a di- or tri-hydrocarbyl phosphite and an amine compound as disclosed in PCT Patent Publication No. WO88/3554, and (7) a reaction product of (i) β-hydroxyethylthioether compound, (ii) phosphite hydrogen dihydrocarbyl and/or phosphite trihydrocarbyl and (iii) a compound containing a reactive hydroxyl group and containing no reactive mercapto group or —$SCH_2CH_2OH$ as disclosed in PCT Patent Publication No. WO89/12666.

However, these phosphate ester-based and phosphite ester-based lubricant additives not always provide all of the scoring resistance, the wear resistance and the prolonged surface fatigue life with the lubricants to a sufficient extent.

Alternatively, attempts have been made to use additives such as a sulfur-based additive, a phosphorus-based additive and a ZnDTP (Zirc dialkyl dithiophosphate) additive alone or in combination, which are known as extreme pressure additives for the lubricant used in the automobile transmission. Sufficient wear resistance, scoring resistance and surface fatigue life cannot, however, be obtained concurrently.

Further, it is known that a combination of a sulfur/phosphorus-based additive and a molybdenum-based additive can enhance the surface fatigue life. It is, however, difficult to apply the system to the traction drive fluid, since a friction coefficient of the continuous variable transmissions decreases in the combination system,.

SUMMARY OF THE INVENTION

An object of the present invention is to provide a novel additive that provides excellent wear resistance, excellent scoring resistance and prolonged surface fatigue life with a lubricant for automobile transmissions, especially with a traction drive fluid for automobile continuous variable transmissions; and to provide the traction drive fluid that has excellent wear resistance, excellent scoring resistance and prolonged surface fatigue life and are especially suitable for automobile traction drive continuous variable transmissions.

Through intense studies for developing such lubricant additive and the lubricant having above-described excellent properties, the present inventors have found that an additive obtained by heating acidic phosphate ester or a phosphite ester having a specific structure and an imide-based dispersant containing boron under the specific conditions attain the object. It is also found that such additive obtained by heating the phosphate compound and the imide-based dispersant containing boron under the specific conditions to have specific properties is mixed with a base oil at a predetermined ratio, whereby the object is attained. The present invention has been completed based on such discoveries.

Specifically, the present invention provides a lubricant additive, especially an additive for traction drive, obtained by heating an acidic phosphate ester and/or a phosphite ester (A) represented by the general formula (I):

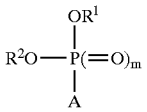

(I)

(wherein A represents a hydrogen atom or a hydroxyl group, m is 0 or 1, when m is 0, A is a hydroxyl group, and when m is 1, A is a hydrogen atom or a hydroxyl group, $R^1$ and $R^2$ each independently represent a hydrogen atom, or a hydrocarbon group having 1 to 18 carbon atoms that may contain one or more oxygen atoms and/or sulfur atoms, $R^1$ and $R^2$ may be the same or different, but both $R^1$ and $R^2$ are not simultaneously hydrogen atoms) and an imide-based dispersant containing boron (B) at a temperature of 120 to 150° C. for 5 hours or more.

The present invention provides a traction drive fluid comprising a base oil, and 100 to 600 ppm by weight of the additive expressed in terms of the amount of phosphorus in the fluid obtained by heating a phosphate compound (A) and an imide-based dispersant containing boron (B) at 120 to 150° C. for 5 hours or more, wherein a weight ratio of boron to phosphorus (B/P) is 0.05 or more and a ratio of a total acid number (mgKOH/g) to a content of phosphorus (weight %) is 25 or more.

DETAILED DESCRIPTION OF THE INVENTION

The lubricant additive of the present invention is obtained by heating the acidic phosphate ester and/or the phosphite ester (A), and the imide-based dispersant containing boron (B). The acidic phosphate ester or the phosphate ester (A) is represented by the general formula (I).

In the general formula (I), A represents a hydrogen atom or a hydroxyl group, m is 0 or 1, when m is 0, A is a hydroxyl group, and when m is 1, A is a hydrogen atom or a hydroxyl group. $R^1$ and $R^2$ each independently represent a hydrogen atom or a hydrocarbon group having 1 to 18 carbon atoms that may contain one or more oxygen atoms and/or sulfur atoms.

Examples of the hydrocarbon group having 1 to 18 carbon atoms include a linear or branched alkyl group having 1 to 18 carbon atoms, a cycloalkyl group having 3 to 18 carbon atoms, a linear or branched alkenyl group having 2 to 18 carbon atoms, an aryl group having 6 to 18 carbon atoms or an aralkyl group having 7 to 18 carbon atoms. Examples of the alkyl group having 1 to 18 carbon atoms include a methyl group, an ethyl group, an n-propyl group, an isopropyl group, an n-butyl group, an isobutyl group, a sec-butyl group, a tert-butyl group, a pentyl group, a hexyl group, an octyl group, a 2-etylhexyl group, a decyl group, a dodecyl group, a tetradecyl group, a hexadecyl group, an octadecyl group and the like. Examples of the cycloalkyl group having 3 to 18 carbon atoms include a cyclopentyl group, a cyclohexyl group, a methylcyclohexyl group, a cyclooctyl group and the like. Examples of the alkenyl group having 2 to 18 carbon atoms include an allyl group, a propenyl group, a butenyl group, an octenyl group, a decenyl group, an oleyl group and the like. Examples of the aryl group having 6 to 18 carbon atoms include a phenyl group, a tolyl group, a xylyl group, a naphtyl group and the like. Examples of the aralkyl group having 7 to 18 carbon atoms include a benzyl group, a phenetyl group, a naphtylmethyl group and the like.

The hydrocarbon group having 1 to 18 carbon atoms may contain one or more oxygen atoms and/or sulfur atoms. In other words, one or more ether groups or thioether groups, or both may be contained in a main chain. Examples of such hydrocarbon group include a hexyloxymethyl group, a hexyloxyethyl group, an octyloxymethyl group, an octyloxyethyl group, a dodecyloxymethyl group, a dodecyloxyethyl group, a hexadecyloxymethyl group, a hexadecyloxyethyl group, a hexylthiomethyl group, a hexylthioethyl group, an octylthiomethyl group, an octylthioethyl group, a dodecylthiomethyl group, a docecylthioethyl group, a hexadecylthiomethyl group, a hexadecylthioethyl group and the like.

The $R^1$ and $R^2$ may be the same or different.

The acidic phosphate ester of the compound represented by the general formula (1) includes one having a structure represented by the general formula (1-a):

(I-a)

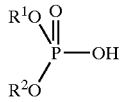

(wherein $R^1$ and $R^2$ are defined as above).

Examples of the acidic phosphate ester represented by the general formula (1-a) include mono- or di-hexylhydrogen phosphate, mono- or di-octylhydrogen phosphate, mono- or di-dodecylhydrogen phosphate, mono- or di-hexadecylhydrogen phosphate, mono- or di-(hexylthioethyl)hydrogen phosphate, mono- or di-(octylthioethyl)hydrogen phosphate, mono- or di-(dodecylthioethyl)hydrogen phosphate, mono- or di-(hexadecylthioethyl)hydrogen phosphate, mono- or di-octenylhydrogen phosphate, mono- or di-oleylhydrogen phosphate, mono- or di-cyclohexylhydrogen phosphate, mono- or di-phenylhydrogen phosphate, mono- or di-toluylhydrogen phosphate, mono- or di-benzhydrogen phosphate, mono- or di-phenetylhydrogen phosphate and the like.

The phosphite ester of the compound represented by the general formula (I) includes an acidic phosphite ester having a structure represented by the general formula (1-b) or (1-c):

(I-b)

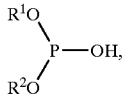

(I-c)

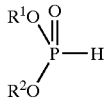

(wherein $R^1$ and $R^2$ are defined as above).

Examples of the acidic phosphite ester represented by the general formula (1-b) or (1-c) include mono- or di-hexylhydrogen phosphite, mono- or di-octylhydrogen phosphite, mono- or di-dodecylhydrogen phosphate, mono- or di-hexadecylhydrogen phosphite, mono- or di-(hexylthioethyl)hydrogen phosphite, mono- or di-(octylthioethyl)hydrogen phosphite, mono- or di-(dodecylthioethyl)hydrogen phosphite, mono- or di-(hexadecylthioethyl)hydrogen phosphite, mono- or di-octenylhydrogen phosphite, mono- or di-oleylhydrogen phosphite, mono- or di-cyclohexylhydrogen phosphate, mono- or di-phenylhydrogen phosphite, mono- or di-toluylhydrogen phosphite, mono- or di-benzylhydrogen phosphite, mono- or di-phenetylhydrogen phosphite and the like.

Among these compounds, di(octylthioethyl)hydrogen phosphite and di(dodecylthioethyl)hydrogen phosphite are especially suitable.

According to the present invention, the acidic phosphate ester and the phosphite ester as the component (A) may be used alone or in combination of two or more thereof.

In the additive of the present invention, the imide-based dispersant containing boron as the component (B) is not especially limited. Any conventional additive commonly used for a lubricant can be selected and used. The imide-based dispersant containing boron includes a monopolyalkenyl or polyalkyl succinimide represented by the general formula (VII):

(VII)

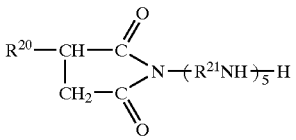

or bispolyalkenyl or polyalkyl succinimide represented by the general formula (VIII):

(VIII)

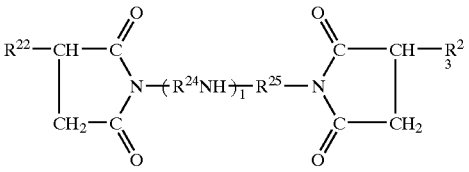

that is treated with a boron compound.

In the general formulae (VII) and (VIII), $R^{20}$, $R^{22}$ and $R^{23}$ are each independently an oligomer residue of α-olefin having 2 to 8 carbon atoms or a hydrate thereof, and $R^{22}$ and $R^{23}$ may be the same or different. $R^{21}$, $R^{24}$ and $R^{25}$ are each independently an alkylene group having 2 to 4 carbon atoms, and $R^{24}$ and $R^{25}$ may be the same or different. s represents an integer of 1 to 10 and t represents 0 or an integer of 1 to 10. According to the present invention, a boron mono-compound represented by the general formula (VII) or a boron bis-compound represented by the general formula (VIII), or a mixture thereof may be used as the imide-based dispersant (B).

As the component (B), the polyalkenyl succinimide is preferred. Polybutenyl succinimide having a weight average molecular weight of about 500 to 3000 is especially suitable. A nitrogen and boron contents are not especially limited.

The lubricant additive of the present invention is obtainable by heating the component (A) and the component (B) in the temperature range of 120 to 150° C. for 5 hours or more. Specifically, the component (A) and the component (B) are mixed so that a weight ratio of boron to phosphorus (B/P) is preferably 0.05 or more, and then agitated at about 40° C. to 70° C. for about 10 minutes to 3 hours to be homogenized. In the case that the weight ratio of boron to phosphorus (B/P) is less than 0.05, it is difficult to obtain the lubricant additive having desired properties. In view of the properties of the additive, the B/P ratio is preferably in the range of 0.1 to 0.5.

A ratio (TAN/Pc) of a total acid number TAN (mgKOH/g) to a content of phosphorus Pc (weight %) in the homogenized matter is normally 20 or less.

The homogenized matter is heated at 120 to 150° C. for 5 hours or more, preferably 5 to 24 hours. The heating may be conducted under standing or agitation. If the heating temperature is not within the above-mentioned range or the heating time is less than 5 hours, the additive having desired properties cannot be obtained.

The thus-prepared lubricant additive of the present invention generally has the TAN/Pc ratio of 25 or more, preferably 30 or more. If the TAN/Pc ratio after heating is 25 or less, it is difficult to obtain the additive having desired properties.

The additive of the present invention is added to a lubricant for automobile transmissions, industrial gears and industrial transmissions, especially to a lubricant for automobile transmissions and a traction drive fluid for use in traction drive devices such as automobile continuous variable transmissions and industrial continuous variable transmissions as an extreme pressure agent, an anti-wear agent, a friction adjusting agent (a friction modifier) and an ashless dispersant, whereby excellent corrosion resistance, excellent scoring resistance and a prolonged surface fatigue lifetime are concurrently obtained.

The lubricant additive of the present invention can be used in combination with other known lubricant additives such as an anti-wear agent, a friction modifier, an extreme pressure additive, an antioxidant, a detergent, an ashless dispersant, a viscosity index improver, a pour point depressant, a rust preventive, a corrosion inhibitor and a defoaming agent as desired.

The traction drive fluid of the present invention comprises a base oil, and 100 to 600 ppm by weight of the additive expressed in terms of the amount of phosphorus in the fluid obtained by heating a phosphate compound (A) and an imide-based dispersant containing boron (B) at a temperature of 120 to 150° C. for 5 hours or more, wherein a weight ratio of boron to phosphorus (B/P) is 0.05 or more and a ratio of a total acid number (mgKOH/g) to a content of phosphorus (weight %) is 25 or more. As the phosphate compound (A) and the imide-based dispersant containing boron (B), the acidic phosphate ester and/or the phosphite ester (A) represented by the general formula (I), and the imide-based dispersant containing boron (B) used in the lubricant additive of the present invention can be preferably used, respectively.

The base oil in the traction drive fluid of the present invention is not especially limited. Any conventional traction drive fluid commonly used can be appropriately selected and used. Examples of the base oil include mineral oils such as paraffin-base mineral oil, naphthene-base mineral oil and intermediate-base mineral oil; and synthetic oils such as a saturated hydrocarbon compound having at least one selected from a cyclohexane ring, a decalin ring, a bicycloheptane ring and a bicyclooctane ring, a hard type alkylbenzene, a polybutene, an ester compound and an ether compound. The saturated hydrocarbon compound having a cyclohexane ring disclosed in Japanese Patent Publication Nos. Hei3-80191, Hei2-52958 and Hei6-39419; the saturated hydrocarbon compound having a decalin ring disclosed in Japanese Patent Publication No. Sho60-43393; the saturated hydrocarbon compound having a bicycloheptane ring disclosed in Japanese Patent Publication Nos. Hei5-31914 and Hei7-103387 such as 1-cyclohexyl-1-decalylethane, 1,3-dicyclohexyl-3-methylbutane, 2,4-dicyclohexylpentane, 1,2-bis(methylcyclohexyl)-2-methylpropane, 1,1-bis(methylcyclohexyl)-2-methylpropane, 2,4-dicyclohexyl-2-methylpentane; and the saturated hydrocarbon compound having a bicyclooctane ring disclosed in Japanese Patent Laid-Open Publication No. Hei5-9134 can be used.

The base oil is generally used so that the amount of the 20 base oil is 80% or more by weight based on the traction drive fluid.

According to the present invention, the base oil may be used alone or in combination with two or more thereof.

In the traction drive fluid of the present invention, 100 to 600 ppm by weight of the additive expressed in terms of the amount of phosphorus in the fluid should be mixed therein. If the amount is less than 100 ppm by weight, the surface fatigue lifetime cannot be prolonged and scuffing resistance is poor. If the amount exceeds 600 ppm by weight, the surface fatigue lifetime is not so prolonged as expected, which is not economical and rather wasteful, and corrosion may be increased.

Other known additives can be blended into the traction drive fluid of the present invention, as required. Examples of the additives include a phenol-based, amine-based or zinc dialkyl dithiophosphate-based antioxidant; an imide-based, ester-based, benzylamine-based, phenate-based, or salicylate-based detergent or dispersant; an amide-based, ester-based or fatty acid-based friction modifier; a phosphorus-based or sulfur-based extreme pressure agent or anti-wear agent; a metal sulfonate-based, succninate ester-based or sorbitan ester-based rust preventive; a benzotriazole-based or thiaziazol-based metal deactivator; a silicone-based defoaming agent and the like.

The lubricant additive of the present invention can concurrently provide excellent wear resistance, excellent scoring resistance and prolonged surface fatigue life while keeping the balance of these properties at an optimum level by adding it to the lubricant for use in automobile transmissions, industrial gears and industrial transmissions, especially to the lubricant for use in automobile transmissions such as traction drive continuous variable transmissions, push-belt type continuous variable transmissions and automatic transmission. The traction drive fluid of the present invention has highly balanced properties such as wear resistance, scoring resistance and prolonged surface fatigue life, and is suitably used especially for automobile traction drive continuous variable transmissions.

The lubricant for use in a miniaturized transmission having a large transmission capacity, especially the traction drive fluid can be prepared by using the additive of the present invention.

Examples of the present invention and Comparative Examples are given below by way of illustration of the claimed invention, and are not in any way designed to limit its scope.

The total acid values and properties of the additive are determined as follows:

(1) Total Acid Value

The total acid value TAN (mgKOH/g) of a homogenized matter and a heated matter were determined in accordance with JIS K2501. A TAN/Pc ratio is calculated based on the TAN and an amount of phosphorus Pc (% by weight).

(2) Seizure Resistance by a FZG Gear Test

FZG test oil was prepared by adding the additive in an amount of 200 ppm by weight expressed in terms of the amount of phosphorus to mineral oil 150 neutral oil and was used for test to measure seizure resistance.

In accordance with ASTM D5182-91, the test was conducted at 90° C. and at 1450 rpm for 15 minutes under a scuffing load stage.

(3) FZG Surface Fatigue Life

A FZG pitting test was conducted using the FZG test oil obtained in the above (2) test at 90° C. under Type C Gears, Load $9^{th}$ Stage.

(4) Bearing Fatigue Life

A test was conducted using SODA type 4 balls friction tester at 1450 rpm, at a mean Hz pressure of 1.87 Gpa and at 100° C. in accordance with JIS K2519. The bearing fatigue life was evaluated as time (hr) until the bearing was peeled. The test bearings were thrust ball bearing #51405 (consisting of total 9 balls) in a 3 balls mode.

EXAMPLES 1 TO 11 AND COMPARATIVE EXAMPLES 1 TO 3

Di(octylthioethyl)hydrogen phosphite (total acid value of 138 mgKOH/g, P:8.5% by weight, S:11.6% by weight) and an imide-based dispersant containing boron ("ECA5025" available from Exxon Chemical Ltd., total acid value of 6.5 mgKOH/g, N:1.35% by weight, B:0.35% by weight) were mixed so that each B/P weight ratio was to be the value shown in Table 1, and agitated for 1 hour at 60° C. to provide each homogenized matter. Each homogenized matter was heated under the specified temperature and time shown in Table 1 to produce each additive.

Table 1 shows TAN/Pc ratios in respective homogenized matters and heated matters, and properties of respective additives.

EXAMPLE 12

Di(dodecylthioethyl)hydrogen phosphite (total acid value of 94 mgKOH/g, P:5.7% by weight) and an imide-based dispersant containing boron ("ECA5025" available from Exxon Chemical Ltd., total acid value of 6.5 mgKOH/g, N:1.35% by weight, B:0.35% by weight) were mixed so that B/P weight ratio was to be the value shown in Table 1, and agitated for 1 hour at 60° C. to provide a homogenized matter. The homogenized matter was heated under the specified temperature and time shown in Table 1 to produce an additive.

Table 1 shows TAN/Pc ratios in the homogenized matter and the heated matter, and properties of the additive.

TABLE 1-1

| | | Example | | | | |
|---|---|---|---|---|---|---|
| | | 1 | 2 | 3 | 4 | 5 |
| Heating | Temp (° C.) | 120 | 120 | 120 | 130 | 140 |
| | Time (hr) | 6 | 10 | 15 | 6 | 5 |
| B/P weight ratio | | 0.3 | 0.3 | 0.3 | 0.3 | 0.3 |
| TAN/Pc ratio | Homogenized matter | 18.6 | 18.6 | 18.6 | 18.6 | 18.6 |
| | Heated matter | 25.6 | 31.4 | 35.6 | 31.0 | 33.0 |
| Seizing resistance by FZG gear test (scuffing load stage) | | 11 | — | 11 | — | — |
| FZG surface fatigue lifetime (hr) | | 137 | — | 156 | — | — |

TABLE 1-2

| | | Example | | | | |
|---|---|---|---|---|---|---|
| | | 6 | 7 | 8 | 9 | 10 |
| Heating | Temp (° C.) | 140 | 130 | 130 | 130 | 130 |
| | Time (hr) | 10 | 10 | 10 | 10 | 10 |
| B/P weight ratio | | 0.3 | 0.05 | 0.1 | 0.2 | 0.02 |
| TAN/Pc ratio | Homogenized matter | 18.6 | 17.1 | 18.0 | 18.7 | 16.5 |
| | Heated matter | 37.3 | 25.2 | 28.7 | 33.6 | 21.0 |
| Seizing resistance by FZG gear test (scuffing load stage) | | 11 | 11 | — | 11 | — |
| FZG surface fatigue lifetime (hr) | | 152 | 120 | — | 147 | — |

TABLE 1-3

| | | Example | | Comparative Example | | |
|---|---|---|---|---|---|---|
| | | 11 | 12 | 1 | 2 | 3 |
| Heating | Temp (° C.) | 130 | 130 | 130 | 100 | 110 |
| | Time (hr) | 10 | 10 | 10 | 10 | 10 |
| B/P weight ratio | | 0.04 | 0.3 | 0 | 0.3 | 0.3 |
| TAN/Pc ratio | Homogenized matter | 16.8 | 16.5 | 16.2 | 18.6 | 18.6 |
| | Heated matter | 22.5 | 31.8 | 17.8 | 21.6 | 23.4 |
| Seizing resistance by FZG gear test (scuffing load stage) | | 11 | — | 11 | — | — |
| FZG surface fatigue lifetime (hr) | | 87 | — | 62 | — | — |

EXAMPLES 1 TO 11, COMPARATIVE EXAMPLES 1 TO 3

Di(octylthioethyl)hydrogen phosphite was used as a phosphite ester.

EXAMPLE 12

Di(dodecylthioethyl)hydrogen phosphite was used as a phosphite ester.

PREPARATION OF ADDITIVES 1 TO 4

Four homogenized matters were obtained by the similar method as described in Example 1. Three homogenized matters were heated at 120 to 130° C. for appropriate time period to prepare additives 1 to 3. An additive 4 is a homogenized matter that was not heated. These four additives have different TAN/Pc ratios of total acid number TAN (mgKOH/g) to phosphorus content Pc (% by weight).

| |
|---|
| Additive 1: TAN/Pc = 35.6 |
| Additive 2: TAN/Pc = 31.4 |
| Additive 3: TAN/Pc = 25.6 |
| Additive 4: TAN/Pc = 18.6 |

EXAMPLES 13 TO 17 AND COMPARATIVE EXAMPLE 4

Each additive shown in Table 2 was mixed with base oil consisting of 1, 3-dicyclohexyl-1,1,3-trimethylpropane [kinematic viscosity: 20.4 $\mu m^2$ sec (40° C.), 3.62 $mm^2$/sec (100° C.)] based on the total weight of the fluid so that each phosphorus content was to be the value shown in Table 2. To each mixture, 0.5% by weight of 4,4'-methylenebis(2,6-d-tert-butylphenol) (available from Ethyl Japan Corp.,), 0.5% by weight of 4,4'-dioctyldiphenylamine (available from Kawaguchi Chemical Industry Co., Ltd.), 1% by weight of polybutenyl succinimide (available from Oronite Japan Limited), 0.3% by weight of monoglyceride oleate (available from Kao Corporation), 0.02% by weight of 1,2,3-benzotriazol (available from Johoku Chemical Co., Ltd.) and 0.002% by weight of polydimethylsiloxane (available from Shin-Etsu Chemical Co., Ltd.) were mixed to prepare each traction drive liquid.

Table 2 shows each property of each traction drive fluid.

TABLE 2

| | Additive | | Seizing | |
|---|---|---|---|---|
| | Type | Phosphorus amount in the liquid (weight ppm) | resistance by FZG gear test (scuffing load stage) | Bearing fatigue lifetime (hr) |
| Example 13 | Additive 1 | 300 | 11 | 132 |
| Example 14 | Additive 2 | 300 | 11 | 124 |
| Example 15 | Additive 3 | 300 | 11 | 104 |
| Example 16 | Additive 2 | 100 | 10 | 108 |
| Example 17 | Additive 2 | 600 | 12 | 120 |
| Comparative Example 4 | Additive 4 | 300 | 11 | 18 |

What is claimed is:

1. A method for transmitting automatically in an automobile transmission selected from the group consisting of traction drive continuous variable transmissions and push-belt type continuous variable transmissions, which method comprises adding an additive to traction drive fluid wherein the additive is obtainable by heating (A) at least one ester selected from an acidic phosphate ester and a phosphite ester represented by the general formula (I):

(I)

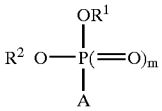

wherein A represents a hydrogen atom or a hydroxyl group, m is 0 or 1, when m is 0, A is a hydroxyl group, and when m is 1, A is a hydrogen atom or a hydroxyl group, $R^1$ and $R^2$ each independently represent a hydrogen atom, or a hydrocarbon group having a 1 to 18 carbon atoms that contains at least one selected from an oxygen atom and a sulfur atom, $R^1$ and $R^1$ may be the same or different, but both $R^1$ and $R^2$ are not simultaneously hydrogen atoms;

and (B) a succinimide dispersant containing boron at 120 to 150° C. for 5 hours or more.

2. The method according to claim 1, wherein a ratio of the component (A) and the component (B) as a weight ration of boron to phosphorus (B/P) is 0.05 or more.

3. The method according to claim 1, wherein the component (A) is di(octylthioethyl)hydrogen phosphite or di(dodecylthioethyl)hydrogen phosphite.

4. The method according to claim 1, wherein the component (B) is polyalkenyl succinimide that is treated with a boron compound.

5. The method according to claim 1, wherein the heated matter has a ratio TAN/Pc of a total acid number TAN (mgKOH/g) to a content of phosphorus Pc (% by weight) of 25 or more.

6. A traction drive fluid comprising a base oil, and 100 to 600 weight ppm of an additive expressed in terms of the amount of phosphorous contained by heating (A) at least one ester selected from an acidic phosphate ester and a phosphite ester represented by the general formula (I):

(I)

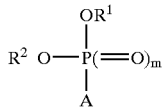

wherein A represents a hydrogen atom or a hydroxyl group, m is 0 or 1, when m is 0, A is a hydroxyl group, and when m is 1, A is a hydrogen atom or a hydroxyl group, $R^1$ and $R^2$ each independently represent a hydrogen atom, or a hydrocarbon group having 1 to 18 carbon atoms that contains at least one selected from an oxygen atom and a sulfur atom, $R^1$ and $R^2$ may be the same or different, but both $R^1$ and $R^2$ are not simultaneously hydrogen atoms;

and (B) a succinimide dispersant containing boron at 120 to 150° C. for 5 hours or more, wherein a weight ratio of boron to phosphorous (B/P) is 0.05 or more and a ratio of a total acid number (mgKOH/g) to a content of phosphorous (weight %) is 25 or more.

7. The traction drive fluid according to claim 6, wherein said succinimide dispersant containing boron is a polyalkenyl succinimide that is treated with a boron compound.

* * * * *